US005180123A

United States Patent [19]

Lin

[11] Patent Number: 5,180,123

[45] Date of Patent: Jan. 19, 1993

[54] STUNT KITE WITH CONTROL MECHANISM

[76] Inventor: Chao-Pin Lin, No. 333, Ta-Chih Road, Taichung City, China

[21] Appl. No.: 804,407

[22] Filed: Dec. 10, 1991

[51] Int. Cl.[5] ..... B64C 31/06

[52] U.S. Cl. ..... 244/155 A

[58] Field of Search ..... 244/153 R, 155 R, 155 A

[56] References Cited

U.S. PATENT DOCUMENTS

| | | | |
|---|---|---|---|
| 2,388,478 | 11/1945 | Garber | 244/155 A |
| 3,355,129 | 11/1967 | Kinsey | 244/155 A |
| 3,358,399 | 12/1967 | Waldman | 244/153 R |
| 3,740,010 | 6/1973 | Curtis | 244/155 A |
| 3,807,672 | 4/1974 | Williams | 244/155 A |
| 4,871,133 | 10/1989 | Alonso | 244/155 A |

*Primary Examiner*—Galen Barefoot

*Attorney, Agent, or Firm*—Bacon & Thomas

[57] ABSTRACT

The present invention relates to a stunt kite comprising a kite with shroud lines and spars in a way arranged to improve flying performance; and a control mechanism composed of a control rod which acts as a lengthened arm of force in order to achieve an easy control of kite, a flying line regulator to regulate two flying lines connected with corresponding shroud lines of the kite so as to obtain sensitive and responsive flying, and a spool device in a way arranged to maneuver the flying lines so that the kite can be launched and retrieved from the hands.

4 Claims, 7 Drawing Sheets

STUNT KITE WITH CONTROL MECHANISM

BACKGROUND OF THE INVENTION

There have been proposed various methods to improve the performance of stunt kite. Among them, the most common way is to modify the shape of kite in order for the kite to have outstanding mobility, or become sensitive and responsive to specify wind speed in the sky. However, the basic configuration for most stunt kites is generally as shown in FIG. 1. Two shroud lines are respectively connected to one end of two parallel horizontal spars. Each shroud line is further connected with another shroud line which is connected to the lower end of a vertical spar, and a flying line which is maneuvered by one hand of the kite operator. With such a configuration of shroud lines and spars, the kite is very sensitive to sudden change of wind speed and/or wind direction, thus, makes the kite operator very difficult to maneuver the kite when there is a sudden change of wind speed and/or direction in the sky.

To improve handling of flying lines, there have been ferrules connected with flying lines and a girdle so that the kite operator may easily maneuver the kite through ferrules with girdle fastened around the waist. Furthermore, reels and handles are also commonly used for storage of flying lines. However, for most of the cases, the stunt kite can only be launched when the flying lines are spooled out a certain length on the ground, and the flying lines always have to be retrieved after the stunt kite is landed on the ground. These make the stunt kite has to be operated by two persons at specious places such as beaches or vast fields.

SUMMARY OF THE INVENTION

The stunt kite according to the present invention comprises a kite having a shroud line and spar arrangement to improve flying stability, and a control mechanism for the kite operator to maneuver the kite flying in the sky at will. The kite of the invention is generally divided by a vertical spar into two equal wings. A horizontal spar is installed perpendicularly across the vertical spar on the upper part of the kite with both ends fixed to the outer edges of the right and left wings. On the opposite kite face, there are two shroud lines each with one end penetrated through the kite wing and fixed together to the lower end of vertical spar, while the other ends of both shroud lines are also penetrated through the kite wing and fixed respectively to the horizontal spar at corresponding positions. The three fixed points of these two shroud lines form an isosceles triangle on the kite wing, and the area of which is designed to be smaller than the area of each wing adjacent to the triangle area. It is because the area of wings adjacent to the triangle area are larger than that of the triangle that the kite wing may stabilize itself when there is a sudden change of wind speed and/or wind direction resulted in unbalance of wind force applied to the right and left wings. Two flying lines are extended out of the control mechanism and connected to the shroud lines respectively.

The control mechanism of the invention comprises a control rod, a flying line regulator and a spool device. The spool device is composed of a cable reel for storage of flying lines, a stopper mechanism for stopping the extended flying lines at desired length, and a cable stretch regulator for adjusting the stretch of flying lines in case both flying lines have different cable stretch under tension. The flying line regulator has generally a lever-pulley configuration which may change the effective such as spins or turns in the sky. The control rod is basically a straight rod on which the spool device and flying line regulator are sequentially mounted. Basically, the control rod acts, similar to a fishing rod, as a lengthened arm of force to magnify force applied to the flying lines so that the operator may easily maneuver the kite flying in the sky.

Accordingly, a primary object of the present invention is to provide a stunt kite which can stabilize itself by means of shroud lines and spars configuration when response to sudden change of wind force applied on the kite wing.

Another object of the present invention is to provide a stunt kite with spool device which may store the flying lines and keep the flying lines at desired length.

Yet another object of the present invention is to provide a stunt kite with a flying line regulator which may regulate the effective length of extended flying lines so as to maneuver the flying performance of kite in the sky.

Still another object of the present invention is to provide a stunt kite with a control rod which can magnify the force applied to the flying lines so as to control the movement of kite easily.

Still another object of the present invention is to provide a stunt kite with a control mechanism comprising a control rod, a flying line regulator and a spool device, which may be launched or retrieved form the operator's hands.

These and additional objects, if not set forth specifically herein, will be readily apparent to those skilled in the art from the detailed description of preferred embodiment according to the invention provided herebelow with reference to the accompanying drawings.

DETAILED DESCRIPTION OF THE PREFERRED EMBODIMENT

Figure 1:
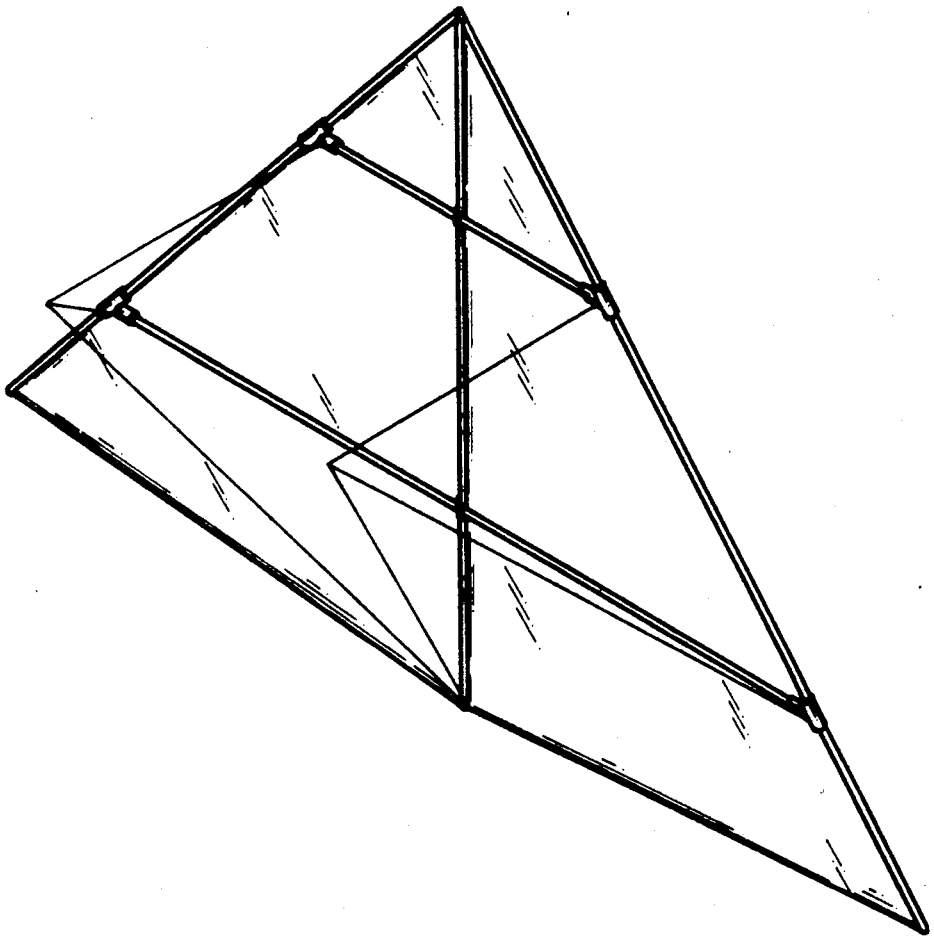
FIG. 1 PRIOR ART
FIG. 1 is a perspective view of a stunt kite prior to the skill.
Figure 2:
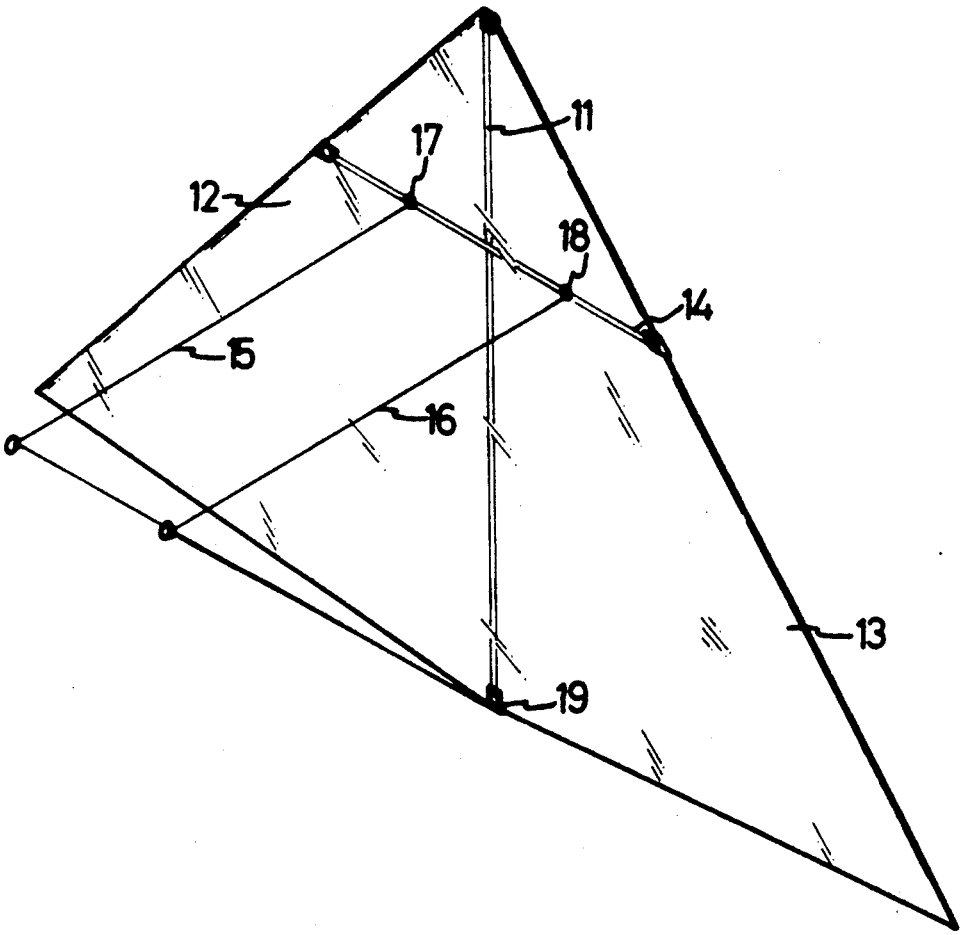
FIG. 2 is a perspective view of a kite according to the present invention.
Figure 3A:
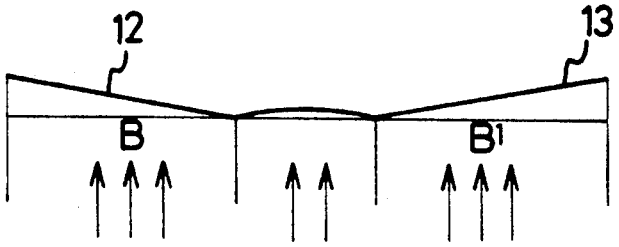
FIG. 3*a* is a schematic front view of a kite according to the present invention showing the kite in a balanced flying condition.
Figure 3B:
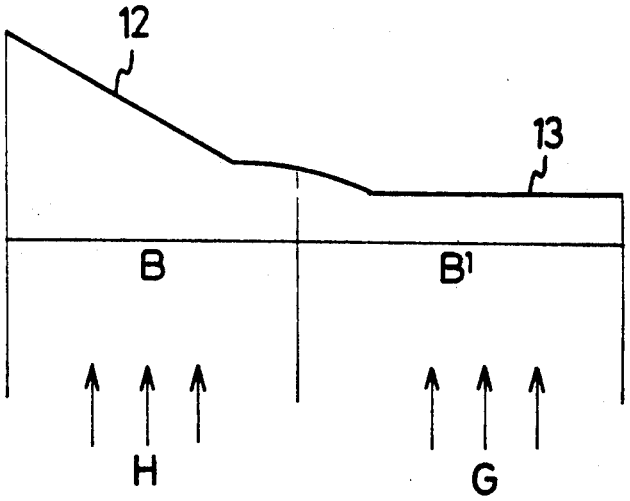
FIG. 3*b* is a schematic front view of the kite according to the present invention showing the kite in temporary titled condition.
Figure 4:
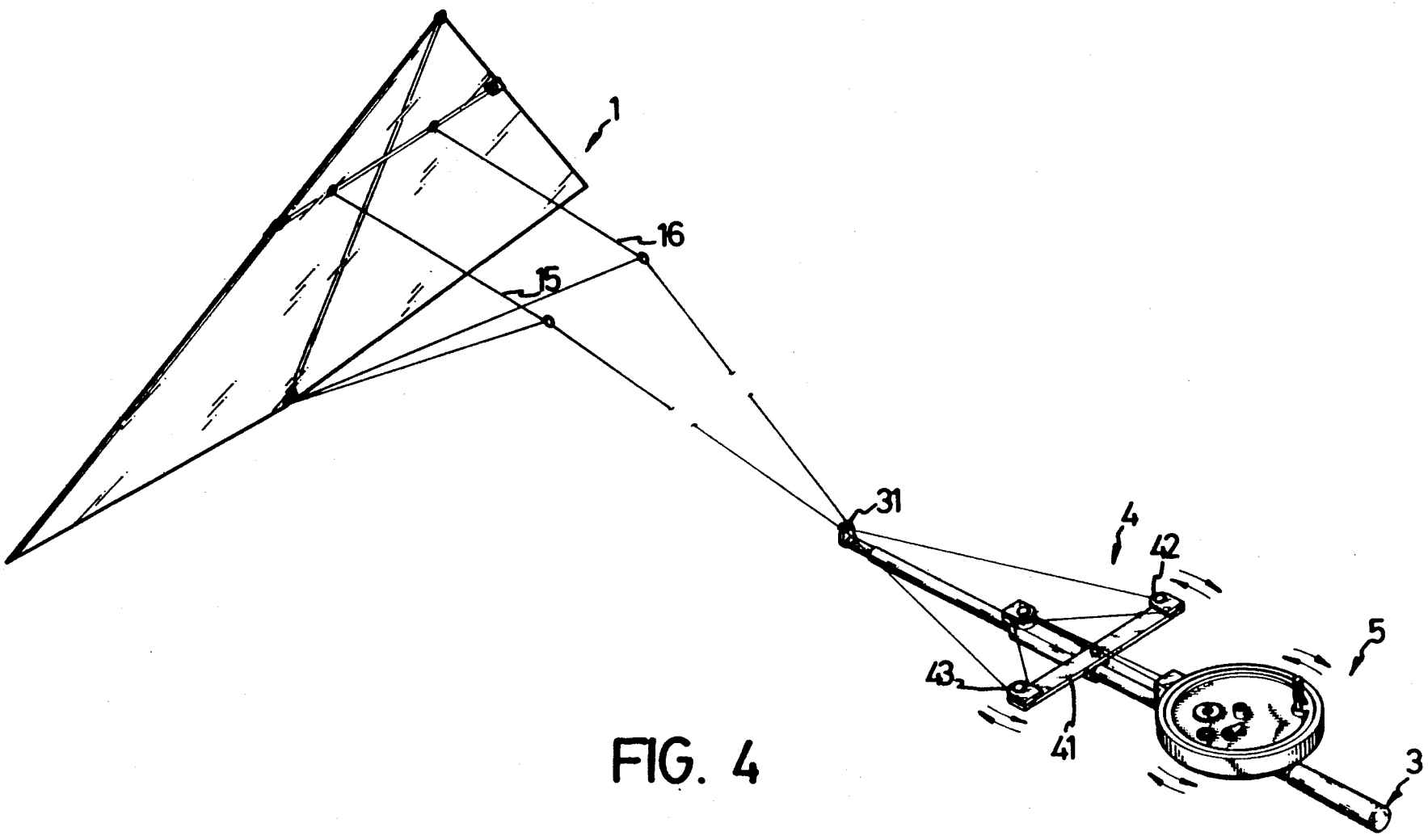
FIG. 4 is a perspective view of a stunt kite with control mechanism according to the present invention.
Figure 5:
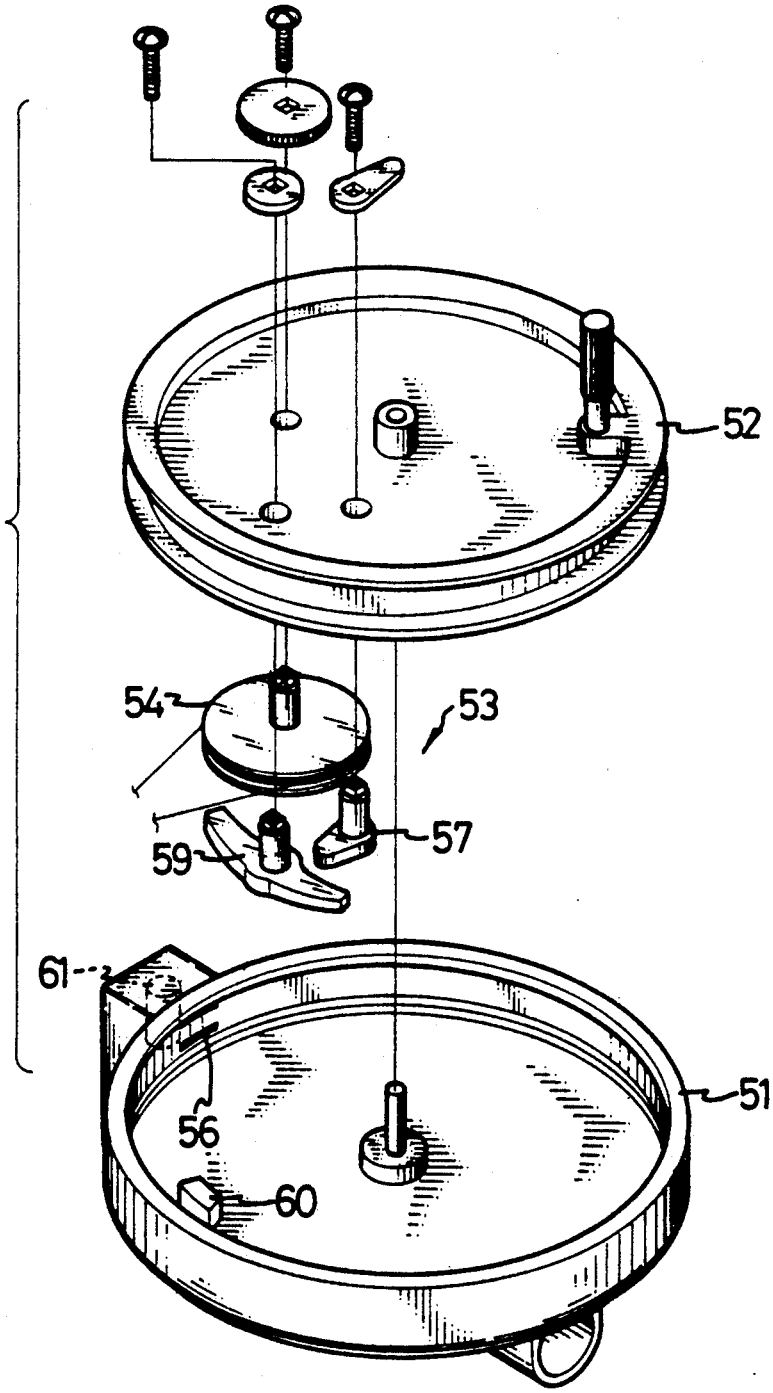
FIG. 5 is an exploded view of a spool device according to the present invention.
Figure 7:
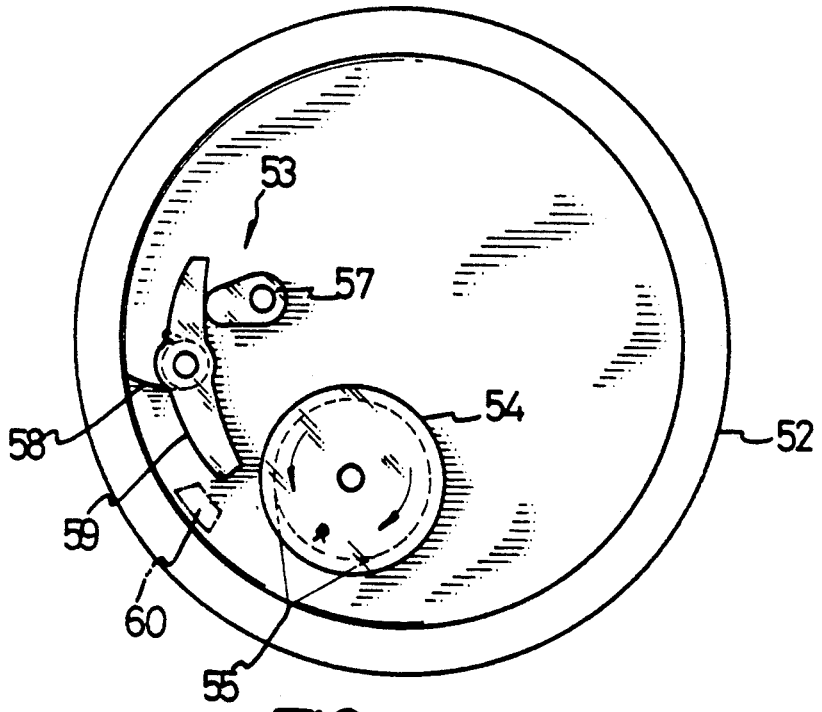
FIG. 7 is a drawing showing the spool device of FIG. 6 in released position.
Figure 6:
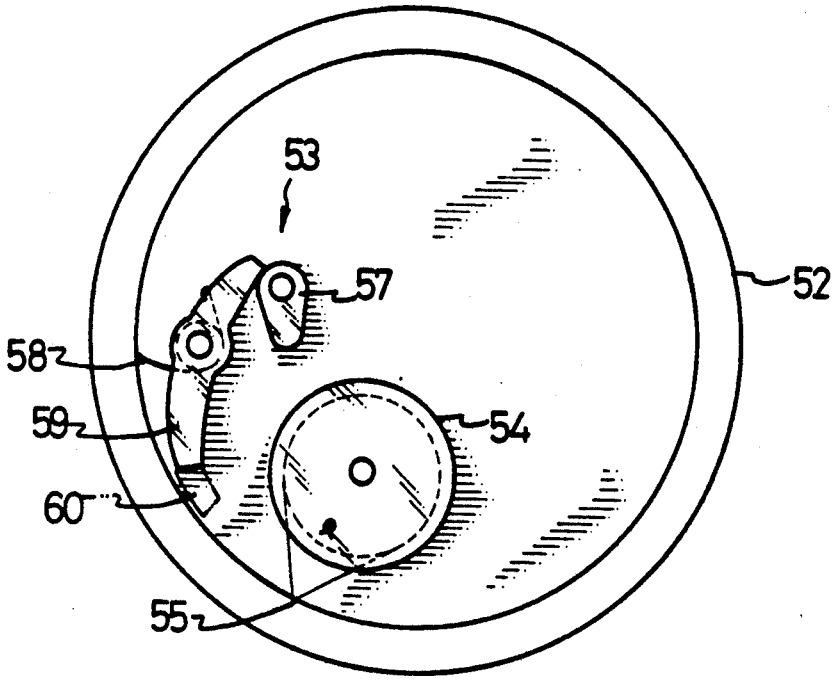
FIG. 6 is an elevational cutting view of the spool device of FIG. 5 showing the spool device in stopped position.
Figure 8:
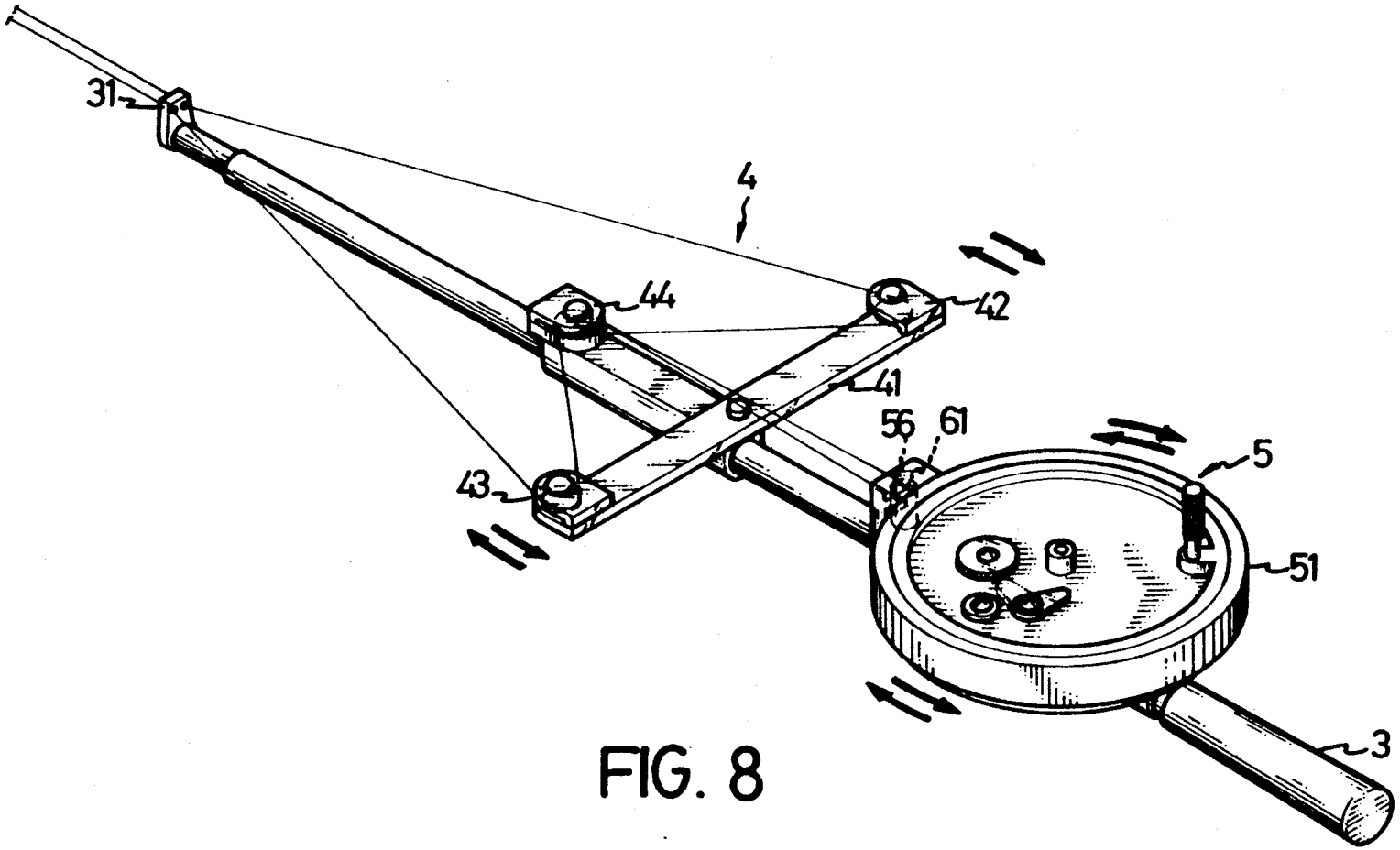
FIG. 8 is a perspective view of the control mechanism according to the present invention.

A preferred embodiment of stunt kite with control mechanism according to the present invention is shown in FIG. 4. The stunt kite is composed of a kite 1 and a control mechanism 2. Please refer to FIG. 2, a kite according to the invention is generally divided by a vertical spar 11 into two equivalent kite wings 12 and 13. A horizontal spar 14 is installed perpendicularly across the vertical spar 11 at the upper part of kite with both ends connected respectively to the outer edges of both kite wings 12 and 13. Optionally, connection of the horizontal spar 14 to the kite wings can be designed to be detachable for easy transportation. On the other face of the kite opposite to the side with vertical and horizontal spars, a shroud line 15 is arranged with one end penetrated through the left wing 12 and connected to the horizontal spar 14, and with the other end penetrated through the kite and connected to the lower end of vertical spar 11. Similarly, there is another shroud line 16 with both ends connected to the horizontal spar and vertical spar respectively. It is to be emphasized that the fixation points 17, 18 and 19 of two shrouud lines 15 and 16 from an isosceles triangle area on the kite face which is primary area to face against the wind, while the area of left or right wing 12 or 13 outside the triangle area is to act as a stabilizer which may balance the kite itself in various wind streams. Preferably, the triangle area is designed smaller than the adjacent wing area which will act as a stabilizer while flying, in order for the kite to stabilize itself easily when there is any sudden change of wind speed and/or wind direction. Please refer to FIGS. 3*a* and 3*b*, when the kite according to the present invention faces against the wind, the areas of left and right wings 12 and 13 will generally bend upwards. In FIG. 3*a*, the kite is in a balanced condition in which the wind forces D and D' applied to the effective areas B and B' corresponding to the left and right wings 12 and 13 are equivalent. In case the kite flys into a zone with uneven distributed wind stream, or in case there is a sudden change of wind speed and/or wind direction, resulting in unequivalent wind forces applied to the left and right wings of the kite, for instance, as shown in FIG. 3*b*, if the wind force H applied to the left wing 12 is stronger than the wind force G applied to the right wing 13, the left wing 12 of the kite will tend to be pushed upwards and the right wing 13 of the kite will tend to be turned downwards to a horizontal position. However, the effective force required to push the left wing 12 upwards, which is proportional to wind force H and effective area B, is becoming weaker because the effective area B is becoming smaller while the left wing 12 is tilting upwards, and at the same time the effective force G applied to the right wing 13 is getting stronger because the effective area B' against the wind is getting larger while the right wing 13 is tilting downwards. Accordingly, when the products obtained by multiplication of wind forces and effective areas on both wings become equivalent, i.e. $B \times H = B \times G$, the kite will stop tilting and remain in a balanced condition, and if the wind forces applied to both wings become equivalent again the kite will return to the original position as shown in FIG. 3*a*. FIG. 8 shows a control mechanism according to the present invention. The control mechanism generally comprises a control rod 3, a flying line regulator 4 prvotally mounted on the control rod 3, and a spool device 5 located near the lower end of control rod 3. Please refer to FIGS. 5 and 8, the spool device 5 comprises a reel cover 51 fixed to the control rod 3, a cable reel 52 pivotally coupled with the reel cover 51, and a stopper mechanism 53 provided on the cable reel 52 which is used to stop the flying lines at desired length. Optionally, a cable stretch regulator 54 can be attached to the cable reel 52 to regulate the lengths of flying lines in case the flying lines are stretched unevenly after they are spooled out under tension. In such case, two flying lines are knotted together at one end and fixed to the cable stretch regulator 54, with each flying line wound on to the cable stretch regulator 54 in opposite direction. When there is a difference in lengths of flying lines due to different stretches, the flying lines can be regulated by turning the cable stretch regulator 54 in one direction in order to compensate the length difference, for instance, as shown in FIG. 7. The other ends of both flying lines are passed through a slot 55 on the cable reel 52 and wound on to the cable reel 52 together, then, they are arranged to come out form the cable cover 51 passing by a pulley 61 and through another slot 56 on the cable cover, as shown in FIG. 8. The cable cover 51 according to the present invention is designed to prevent the flying lines form winding off the cable reel 52 in case they are not under tension. The pulley 61 is designed to rotate against the flying lines so as to maintain both flying lines with the same tension. Please further refer to FIGS. 5, 6 and 7, a stopper mechanism 53 generally composed of a cam 57, a spring 58 and a stopper 59 is designed to stop the cable reel 52 from turning at specific position and accordingly maintain the flying lines at desired length. FIG. 6 shows that the stopper 59 is stopped by a protrusion 60 located on the reel cover 51. At this time, the cable reel 52 is stuck on position and thus the flying lines can no more be released from the cable reel 52. Alternatively, when the stopper 59 is turned an angle by the cam 57, it will not be stuck by the protrusion 60 on the cable cover 51, so that the cable reel 52 together with the flying lines will be free of turning so that the flying lines can be spooled out or retrieved freely as shown in FIG. 7.

The flying line regulator 4 is generally composed of a lever 41 pivotally mounted on the control rod 3, a right pulley 42 and a left pulley 43 respectively located at both ends of the lever 41, and a central pulley 44 mounted on the control rod 3 as shown in FIG. 8. Two parallel flying lines coming out of the reel cover 51 are passed around the central pulley 44 together from one side of the central pulley 44, then, one of the flying lines passes around the left pulley 43 and then passes through a wire holder 31 located at the top end of the control rod 3, while the other flying line passes around the right pulley 42 and then also passes through the same wire holder 31 on the control rod 3. Those two flying lines are further connected to the shroud lines 15 and 16 respectively as shown in FIG. 4. Since the lever 41 of flying line regulator 4 is pivotally mounted, the effective lengths of both flying lines, which is the distance between the connection points of flying lines with shroud line 15 or 16 and the right or left pulley 42 or 43, can be changed by turning the lever 41 clockwise or anti-clockwise will result in changing direction of the kite 1 in the sky.

The control rod 3 is basically a straight rod which acts as a lengthened arm of force when maneuvering the kite 1. To strengthen the effectiveness of the control rod 3, it can be alternatively designed to be retractable so as to have a longer length as it is extended. For easy transportation, the connections of shroud lines 15 and 16 and the flying lines can also be designed as detachable by means of hooks or clips. The kite according to the present invention can be launched without spooling out the flying lines completely beforehand as the traditional stunt kites do. The kite of the invention can be easily launched off the ground once the operator wields the control rod according to the wind speed and direction with the kite wings facing against the wind. The kite can also be stopped at desired height in the sky once the stopper mechanism of spool device is actuated. Furthermore, by turning the lever 41 of flying line regulator 4, one can change the flying status of the kite at will easily, which is normally necessry for the kite to fly in the sky with various conditions of wind streams. To retrieve the kite from the sky, one can simply hold the control rod of the invention and actuate the spool device to spool in the flying lines.

While the present invention has been described with reference to its preferred embodiment, it is to be understood that various modifications thereof will be apparent to those skilled in the art upon reading this specification. Therefore, it is to be understood that the invention discloesd herein is intended to cover all such modifications as shall fall within the scope of the appended claims.

I claim:

1. A stunt kite with a control mechanism comprising:

a) a kite body;

b) a pair of flying lines operatively attached to the kite body;

c) a control mechanism comprising:

i) a control rod; and ii) a flying line regulator comprising a lever pivotally attached to said control rod; left and right pulleys located at opposite ends of said lever; a central pulley attached to said control rod on an upper side of said lever; and a wire holder located at an end of said control rod such that said pair of flying lines pass around said central pulley from one side of said central pulley, one of said pair of flying lines then passes around said left pulley before passing through said wire holder, the other of said pair of flying lines passes around said right pulley before passing through said wire holder; and, d) a spool device rotatably attached to said control rod to which said pair of flying lines are attached.

2. A stunt kite with control mechanism according to claim 1, wherein said kite body comprises; a kite wing divided equally by a longitudinal spar into a left wing and a right wing; a transverse spar with both ends fixed to the outer edges of said left and right wings respectively; a first shroud line with one end penetrating through said left wing and connected to said transverse spar and with another end penetrating through said kite body and connected to a lower end of said longitudinal spar; a second shroud line with one end penetrating through said right wing and connected to said transverse spar and with another end penetrating through said kite body and connected, together with said first shroud line, to the lower end of said longitudinal spar, said pair of flying lines being connected to said first and second shroud lines respectively.

3. A stunt kite with control mechanism according to claim 1, wherein said spool device of said control mechanism comprises: a reel cover fixed to said control rod; a cable reel rotatably fixed to said control rod and coupled with said reel cover for winding said pair of flying lines thereon; and a stopper mechanism which may selectively stop or free the turning of said cable reel.

4. A stunt kite with control mechanism according to claim 1, wherein said control rod comprises a generally straight, retractable rod.

* * * * *